US006357427B1

(12) United States Patent
Luttrelll et al.

(10) Patent No.: US 6,357,427 B1
(45) Date of Patent: Mar. 19, 2002

(54) SYSTEM AND METHOD FOR IGNITION SPARK ENERGY OPTIMIZATION

(75) Inventors: Jabe R. Luttrelll, Burlington; David Thibodeau, Coventry; Stephen Santoro, Windsor Locks, all of CT (US)

(73) Assignee: Aerosance, Inc., Farmington, CT (US)

( * ) Notice: Subject to any disclaimer, the term of this patent is extended or adjusted under 35 U.S.C. 154(b) by 0 days.

(21) Appl. No.: 09/268,173

(22) Filed: Mar. 15, 1999

(51) Int. Cl.[7] ..... F02P 9/00
(52) U.S. Cl. ..... 123/609; 123/625
(58) Field of Search ..... 123/609, 625

(56) References Cited

U.S. PATENT DOCUMENTS 4,389,994 A * 6/1983 Denz et al. ..... 123/478
4,625,704 A 12/1986 Wheelock
4,773,380 A 9/1988 Narita et al.
4,788,942 A * 12/1988 Pouring et al. ..... 123/430
4,829,973 A * 5/1989 White ..... 123/609
4,915,086 A 4/1990 Ciliberto et al.
5,007,397 A * 4/1991 Akasu ..... 123/609
5,043,900 A * 8/1991 Allen et al. ..... 123/609
5,048,487 A * 9/1991 Fujimoto ..... 123/609
5,054,461 A * 10/1991 Deutsch et al. ..... 123/609
5,058,021 A * 10/1991 Scott ..... 123/609
5,140,970 A 8/1992 Akaki et al.
5,143,553 A * 9/1992 Mukaihira et al. ..... 123/609
5,334,938 A 8/1994 Kugler et al.
5,456,241 A 10/1995 Ward
5,513,620 A 5/1996 Pyko et al.
5,758,629 A 6/1998 Bahr et al.
5,871,002 A * 2/1999 Nada ..... 123/609

OTHER PUBLICATIONS

Complaint: Richard J. Tems, an individual; and Avant-–Garde Technology, Inc., Plaintiffs, v. Aerosance, Inc., a divison of Teledyne Continental Motors; and Rick F. Quave, Jr., an individual, 00–001528, Circuit Court of Mobile County, Alabama, May 10, 2000.

* cited by examiner

*Primary Examiner*—Erick Solis
(74) *Attorney, Agent, or Firm*—Kirkpatrick & Lockhart LLP

(57) ABSTRACT

A method for controlling spark energy from a spark plug of a combustion engine. The method includes determining a spark energy intensity based on at least one engine operating condition, determining a period of time to supply current to an ignition coil connected to the spark plug to achieve the determined spark energy intensity from the spark plug as a function of a voltage supplied from a power supply to the ignition coil, and connecting the power supply to the ignition coil for the determined period of time.

34 Claims, 4 Drawing Sheets

| Mode Definition | | Starting | Idle | Low Power | LP Cruise | HP Cruise | MCP | Takeoff | Overspeed |
|---|---|---|---|---|---|---|---|---|---|
| Mixture Definition: | | 1.63*BP | 1.23*BP | Stoich. | BE | BE | BP | BP | FL |
| Target F/A (A/F): | | 0.114 (8.8) | 0.070 (14.3) | 0.060 (15.4) | 0.060(16.7) | 0.060(16.7) | 0.070(14.3) | 0.070(14.3) | 0.050(18.2) |
| Speed ranges (rpm) | | Base Spark Timing For Each Applicable Speed/Mode Combination, Degrees BTDC | | | | | | | |
| 0 | 300 | 0 | | | | | | | |
| ≥300 | 900 | | 0 to 18 | | | | | | |
| ≥900 | 2000 | | | 18 | | | | | |
| ≥2000 | 2200 | | | | 18 to 26 | | | | |
| ≥2200 | 2400 | | | | | 26 | | | |
| ≥2400 | 2700 | | | | | | 24 | | |
| ≥2700 | 2820 | | | | | | | 24 | |
| ≥2820 | 2900 | | | | | | | | 24 to 10 |
| Spark Timing Modifiers : | | Spark Advance Hystercsis | | | | | | | |
| | | | | | Knock Retard Strategy | | | | |
| | | | Transition | | Transition | | | | Transition |
| | | | | | | | | | Rev Limit |
| Mixture Modifiers | | | | | Mixture Calibration | | | | Rev Limit |
| | | Cold Start / Idle | | Wind - Milling | | | | | |
| | | Engine Warm-up | | | | | | | |
| | | | | Knock Enrichment Strategy | | | | | |
| | | | Acceleration / Deceleration Strategy | | | | | | |
| | | | | | Cylinder Head Temperature Limit Strategy | | | | |
| | | | | | ECT / TIT Limit Strategy | | | | |

FIG. 3

SYSTEM AND METHOD FOR IGNITION SPARK ENERGY OPTIMIZATION

CROSS-REFERENCE TO RELATED APPLICATIONS

Not Applicable.

STATEMENT REGARDING FEDERALLY SPONSORED RESEARCH AND DEVELOPMENT

Not Applicable.

BACKGROUND OF INVENTION

1. Field of Invention

The present invention is directed generally to a system and method for controlling ignition spark for a combustion engine and, more particularly, to a system and method for optimizing ignition spark based on the engine operating conditions.

2. Description of Background

Modern reciprocating engine control systems are designed to achieve precise control of the fuel-to-air ratio of the charging mixture supplied to the combustion chambers and to control the timing and magnitude of the spark which initiates the combustion process and expansion of the mixture. If the spark occurs too late during the engine cycle, i.e., the spark is too "retarded," or with insufficient energy to achieve a combustion process with the desired rate of flame front propagation, then the combustion and gas expansion process may not be completed before the engine piston has left the power producing portion of that cycle. This may result in less power from the engine, increased fuel consumption, and undesirable levels of exhaust emissions. Conversely, if the spark is too early in the combustion cycle, i.e., the spark is too "advanced," or with too much energy, early detonation of the fuel-air mixture may result, which consequently may cause damaging engine "knock" or excessive cylinder head temperatures, both of which may severely reduce the life of the engine.

Such control is of particular significance for aircraft engines, where it is important for an engine to last a long time, despite the fact that an aircraft engine typically runs "hot" most of its life. For example, aircraft engines are typically designed to operate at relatively low engine speeds to reduce wear and stress on the engine components. Thus, in order to gain the necessary power for flight, the engine cylinders are made relatively large, for example, 1.5 liters. To further enhance durability, when the aircraft engine is cold, because it is relatively difficult to spark the gap of the spark plug, increased spark energy is required to ensure the starting of the aircraft. Conversely, when the engine is hot, less energy is required to spark the gap, allowing engine stress to be decreased by decreasing the spark energy.

Proper control of the ignition spark is made more difficult if the power required to generate the spark is capable of varying over a broad range. In power supplies for aircrafts, for example, the ignition spark typically relies on a twenty-eight volt DC power supply which can typically deteriorate to as low a twelve volts DC during aircraft operation. The power supply is used by an ignition coil to generate a high voltage required by the spark plug to ignite. Because of the vacillation in the voltage supplied to the ignition coil, the ignition spark energy will accordingly vary, resulting in deterioration in the precision of the ignition process.

Modern reciprocating engine control systems utilize digital electronic processors to calculate the desired timing for the ignition spark during the engine cycle based on measured engine operating parameters. Typical relevant art engine control systems do not attempt to vary the intensity of the spark energy, although it may vary significantly over the starting and operational power range of the engine. Further, in the case of an aircraft engine, the spark energy may vary over a wide altitude and speed envelope. In addition, the relevant art engine control sensors do not compensate for variations in electrical power supplied to the ignition coils, except for engines requiring a nominally constant spark energy.

Accordingly, there exists a need in the relevant art for a system and method to optimize and control the spark energy intensity under circumstances of varying electrical power.

SUMMARY OF INVENTION

The present invention is directed to a method for controlling spark energy from a spark plug of a combustion engine including determining a spark energy intensity based on at least one engine operating condition, determining a period of time to supply current to an ignition coil connected to the spark plug to achieve the determined spark energy intensity from the spark plug as a function of a voltage supplied from a power supply to the ignition coil, and connecting the power supply to the ignition coil for the determined period of time.

The present invention represents an advance over prior systems and methods for controlling ignition spark energy in that the present invention compensates for broad variation in the electrical power supplied to the ignition coils in optimizing the energy spark intensity. These and other advantages and benefits of the present invention will become apparent from the description hereinbelow.

BRIEF DESCRIPTION OF THE DRAWINGS

For the present invention to be clearly understood and readily practiced, the present invention will be described in conjunction with the following figures, wherein:

FIG. 3 is a diagram illustrating a basic timing advance schedule which may be used in the present invention.

DETAILED DESCRIPTION OF THE INVENTION

It is to be understood that the figures and descriptions of the present invention have been simplified to illustrate elements that are relevant for a clear understanding of the present invention, while eliminating, for purposes of clarity, other elements found in a typical aircraft propulsion and control system. For example, specific operating system details and modules contained in the electronic engine controller are not shown. Those of ordinary skill in the art will recognize that other elements may be desirable to produce an operational system incorporating the present invention. However, because such elements are well known in the art, and because they do not facilitate a better understanding of the present invention, a discussion of such elements is not provided herein.

Figure 1:
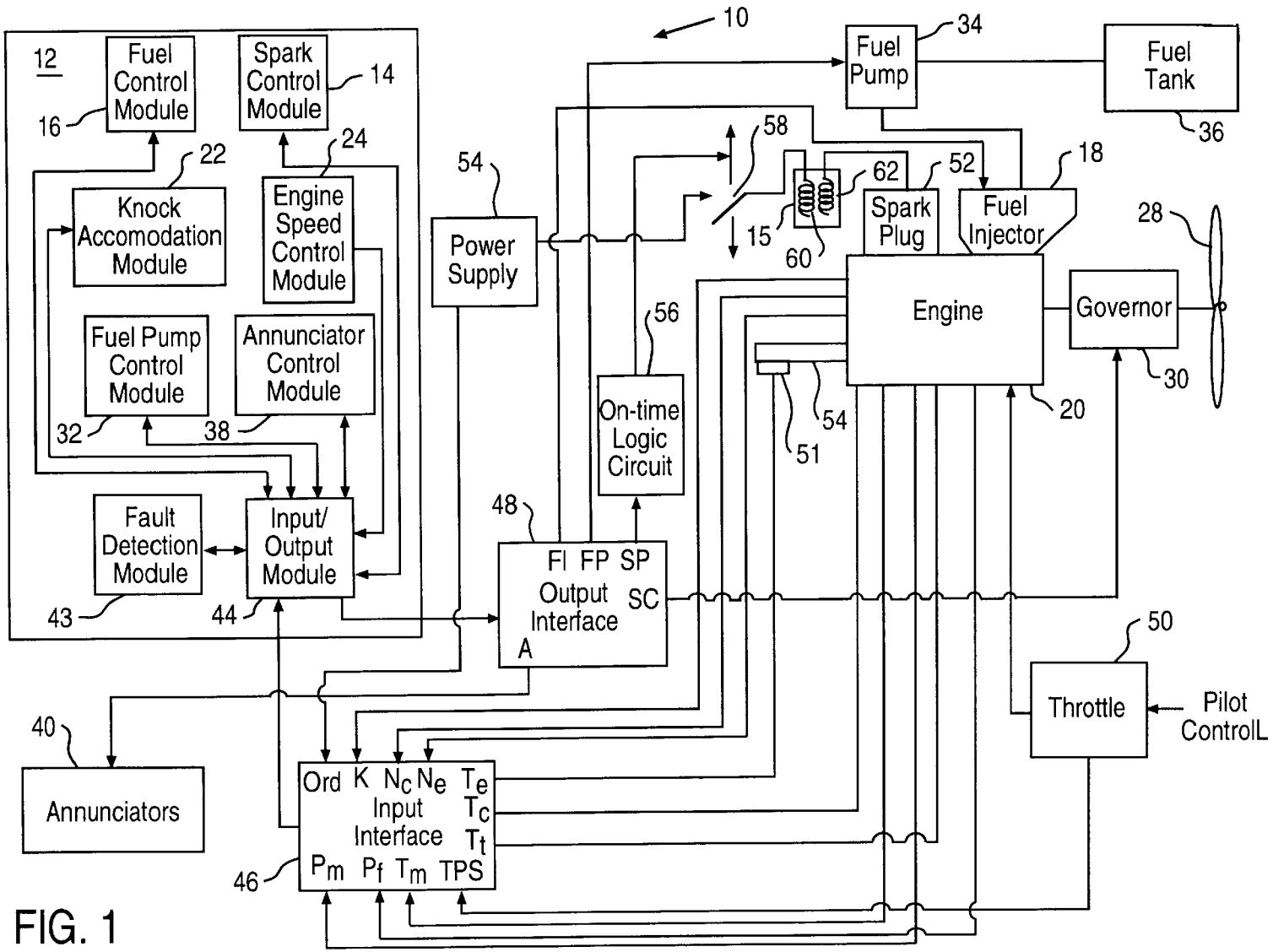
FIG. 1 is a diagram illustrating an aircraft propulsion and control system in which the present invention may be used.

FIG. 1 is a diagram illustrating an aircraft propulsion and control system 10 in which the present invention may be used. The system 10 will be described herein as implemented in an aircraft, although it may be implemented in any combustion engine. The system 10 may be used in an engine of any number of cylinders such as, for example, a four, six, or eight cylinder engine. In addition, the system 10 may be implemented in a naturally aspirated or super-charged aspirated, air-cooled, horizontally opposed, reciprocating direct drive engine.

The system 10 includes an electronic engine controller 12 which accepts various engine parameters as inputs and outputs various control signals to control portions of the system 10. The controller 12 includes a spark control module 14, which generates signals directing the charging and discharging of a spark plug ignition coil 15 to control ignition timing and energy level. A fuel control module 16 generates signals which control the amount of fuel that is delivered by fuel injectors 18. It is desirable to have one fuel injector per cylinder of an engine 20. The fuel injectors 18 can be, for example, electromagnetically operated valves with coils that can be energized and de-energized to open and close the valves. A knock accommodation module 22 generates signals which control engine detonation, or knock, by controlling ignition timing and enriching the fuel mixture at the fuel injectors 18. An engine speed control module 24 generates signals which determine how much current should be applied to a coil (not shown) in a governor 30 to change the angle of a propeller 28.

A fuel pump control module 32 generates signals which control the delivery of fuel by an electric fuel pump 34 from a fuel tank 36 to the fuel injectors 18. An annunciator control module 38 generates signals which determine which of annunciators 40, if any, are illuminated such as during a component failure or when conditions such as low engine oil pressure or high engine oil temperature are present. A fault detection module 42 detects faults in the controller 12 and, upon confirming the presence of a fault, annunciates the fault via the annunciators 40.

An input/output module 44 receives input signals from the an input interface 46 and outputs signals via an output interface 48. The input interface 46 receives various input signals from sensors throughout the system 10. The interface 46 receives a manifold pressure signal Pm from a manifold pressure sensor (not shown) which can be located on, for example, the body of a throttle 50 or on the induction plenum (not shown) or induction splitter (not shown) of the engine 20. The throttle 50 controls the amount of air that is introduced into the cylinders (not shown) of the engine 20. The interface 46 receives a fuel pressure signal Pf from a fuel pressure sensor (not shown) which can be mounted on, for example, the fuel distribution block (not shown) of the engine 20. The manifold pressure and fuel pressure sensors can be, for example, resistance strain gauges. The interface 46 receives a manifold temperature signal Tm from a manifold temperature sensor (not shown) which can be located on, for example, the body of the throttle 50 or on the induction plenum (not shown) or induction splitter (not shown) of the engine 20. The manifold temperature sensor may be, for example, a thermistor. The interface 46 receives a throttle position sensor signal TPS from a throttle position sensor (not shown) located on the body of the throttle 50. The throttle position sensor may be, for example, a potentiometer. The interface 46 receives a turbine inlet temperature sensor signal Tt from a turbine inlet sensor of the engine 20. The interface 46 receives a cylinder head temperature signal Tc from a cylinder head temperature sensor located on, for example, the thermowells of each cylinder (not shown) of the engine 20. The turbine inlet temperature and cylinder head temperature sensor may be, for example, thermistors. The interface 46 receives an exhaust gas temperature signal Te from an exhaust gas temperature sensor 51 which are located in each exhaust pipe 54 at, for example, a location approximately 2 inches from the exhaust pipe to cylinder mating flange (not shown). The exhaust gas temperature sensor may be, for example, a thermocouple. The interface 46 receives a crankshaft speed sensor signal Ne, which may, for example, provide a pulse every 45° of crankshaft rotation and may be used to schedule all software events within the system 10. The interface 46 receives camshaft speed sensor signal Nc from a speed sensor assembly (not shown) which is mounted on the engine 20. The crankshaft speed and camshaft speed sensors may be, for example, Hall effect, magnetically biased, magnetic pickups. The interface 46 receives a knock sensor signal K from a knock sensor (not shown) which is located on, for example, the cylinder heads of air cooled engines and the engine case for unitized block liquid cooled engines. The knock sensor may be, for example, a piezoelectric accelerometer.

The output interface 48 outputs a spark signal SP, which is generated by the spark control module 14 and the knock accommodation module 22, to control the spark coil current and timing of pulses to interrupt the spark coil primary winding current and generate a spark at each spark plug 52 located in the engine 20. The interface 48 outputs a fuel injection signal FI, which is generated by the fuel control module 16 and the knock accommodation module 22, to control the opening and closing of the valves (not shown) in the fuel injectors 18. The fuel control module 16 and the fuel injectors 18 are detailed in a pair of patent applications entitled "Automatic Aircraft Engine Fuel Mixture Optimization" and "Fuel Injector Assembly" respectively, which were filed concurrently herewith by the assignee of the instant application, and which are incorporated herein by reference. The interface 48 outputs a speed control signal SC, which is generated by the engine speed control module 24, to the governor 30. The signal SC can be, for example, a pulse width modulated signal that causes the governor 30 to change the pitch of the propeller 28 as appropriate. The interface 48 outputs a fuel pump control signal FP, which is generated by the fuel pump control module 32, to control the operation of the fuel pump 34. The output interface 48 outputs an annunciator signal A, which is generated by the annunciator control module 38, to the annunciators 40.

The system 10 includes a power supply 54, which may, for example, be a device that produces a controlled DC output, such as an ORing diode, from a variable input power source, such as an alternator or a battery. A signal, Ord, indicative of the voltage outputted from the power supply 54 is input to the input interface 46.

The interfaces 46 and 48 can be implemented using, for example, one or a plurality of RS-485 serial data buses.

The controller 12 can be implemented as, for example, a microprocessor such as, for example, a N87C196KT microprocessor, sold by Intel Corp., of Santa Clara, Calif., with or without internal memory, or an application specific integrated circuit (ASIC). The modules 14, 16, 22, 24, 32, 38, 42 and 44 can be implemented using any type of computer instructions types such as, for example, microcode, and can be stored in, for example, an electrically erasable programmable read only memory (EEPROM) or can be configured into the logic of the controller 12. The controller 12 can be mounted on, for example, the mount frame (not shown) of the engine 20 or on either side of the firewall (not shown) of the engine 20. The power supply 54 and the ignition coil 15 may be housed with the controller 12. For such an embodiment, the ignition coil 15 may be housed in a separately shielded portion of the controller housing to protect the controller 12 from electromagnetic fields generated from the ignition coil 15.

The system 10 includes an on-time logic circuit 56 receiving the signal SP from the controller 12 via the output interface 48. The on-time logic circuit 56 outputs the signal SP to a primary coil switch 58. The switch 58 may be, for example, a field-effect transistor (FET) or a bipolar junction transistor (BJT). The switch 58 operates according to the signal SP transmitted from the controller 12 via the on-time logic circuit 56. The on-time logic circuit 56 may control the switch 58 with positive logic. That is, when the output from the controller 12 is positive, the switch 58 is closed. The ignition coil 15 is connected to the switch 58, and includes a primary winding 60 inductively coupled to a secondary winding 62 configured as a step-up transformer. The secondary winding 62 may have more turns than the primary winding 60 such as, for example, one hundred times more turns. The controller 12 operates the switch 58 through signal SP such that the primary winding 60 is connected to the power supply 54 when the switch 58 is closed and disconnected when the switch 58 is open. The secondary winding 62 is coupled to a spark plug 52.

In operation, when the switch 58 is closed, the power supply 54 supplies electrical current to the primary winding 60, inducing an electromagnetic flux in the coil 15. When the switch 58 opens, the voltage supplied to the primary winding 60 is removed, causing the flux field to collapse. The collapse of the flux field induces a high voltage in the secondary winding 62 because of the turn ratio between the primary winding 60 and the secondary winding 62. A voltage of 12,000–15,000 volts may be realized on the secondary winding 62 due to the voltage supplied to the primary winding 60 and the turn ratio. Such high voltages are sufficient to ionize the spark plug gap of the spark plug 52, causing the spark plug 52 to spark, igniting the fuel-air mixture in the combustion chamber of the engine 20. The energy intensity of the spark from the spark plug 52 is a function of the magnitude of the flux field induced by current in the primary winding 60, and may be expressed as:

$$E_{spark}=\tfrac{1}{2}(LI^2) \quad (1)$$

where L is the inductance of the primary winding 60 and I is the current in the primary winding 60. The current magnitude of the flux field is dependent on the amount of time that the primary winding 60 is connected to the power supply 54 and the magnitude of the voltage supplied from the power supply 54.

The amount of time that the switch 58 is closed is controlled by the controller 12. Based on the various inputs indicative of engine operating conditions, the controller 12 determines the optimal spark energy intensity for the particular engine operating conditions. The amount of time that the switch 58 must be closed in order to achieve the desired spark energy intensity, called the dwell time, may be determined according to the expression:

$$T_{dwell}=(LI)/V \quad (2)$$

where V is the voltage supplied from the power supply 54. Substituting an expression for I derived from equation (1), an expression for the dwell time can be obtained as a function of the desired spark energy intensity, which may be represented as:

$$T_{dwell}=(2EL)^{1/2}/V \quad (3)$$

Thus the amount of time that the switch 58 must be closed in order to achieve a desired spark energy intensity, i.e., the dwell time, is a function of the voltage supplied from the power supply 54. In many engines, however, the voltage supplied from the power supply 54 to the ignition coil 15 may vary significantly. Consequently, to achieve the optimal spark energy intensity considering the operating conditions of the engine, it is necessary to monitor the voltage supplied from the power supply 54.

In addition to determining the optimal spark energy intensity, it is desirous to ignite the spark at the proper time during the engine cycle. Ignition of the spark at the proper time in the engine cycle typically improves, among other things, fuel efficiency and engine service life. The controller 12 may also determine the proper time during the engine cycle to ignite the spark according to the particular engine operating conditions as communicated to the controller 12 via the input interface 46.

Figure 2:
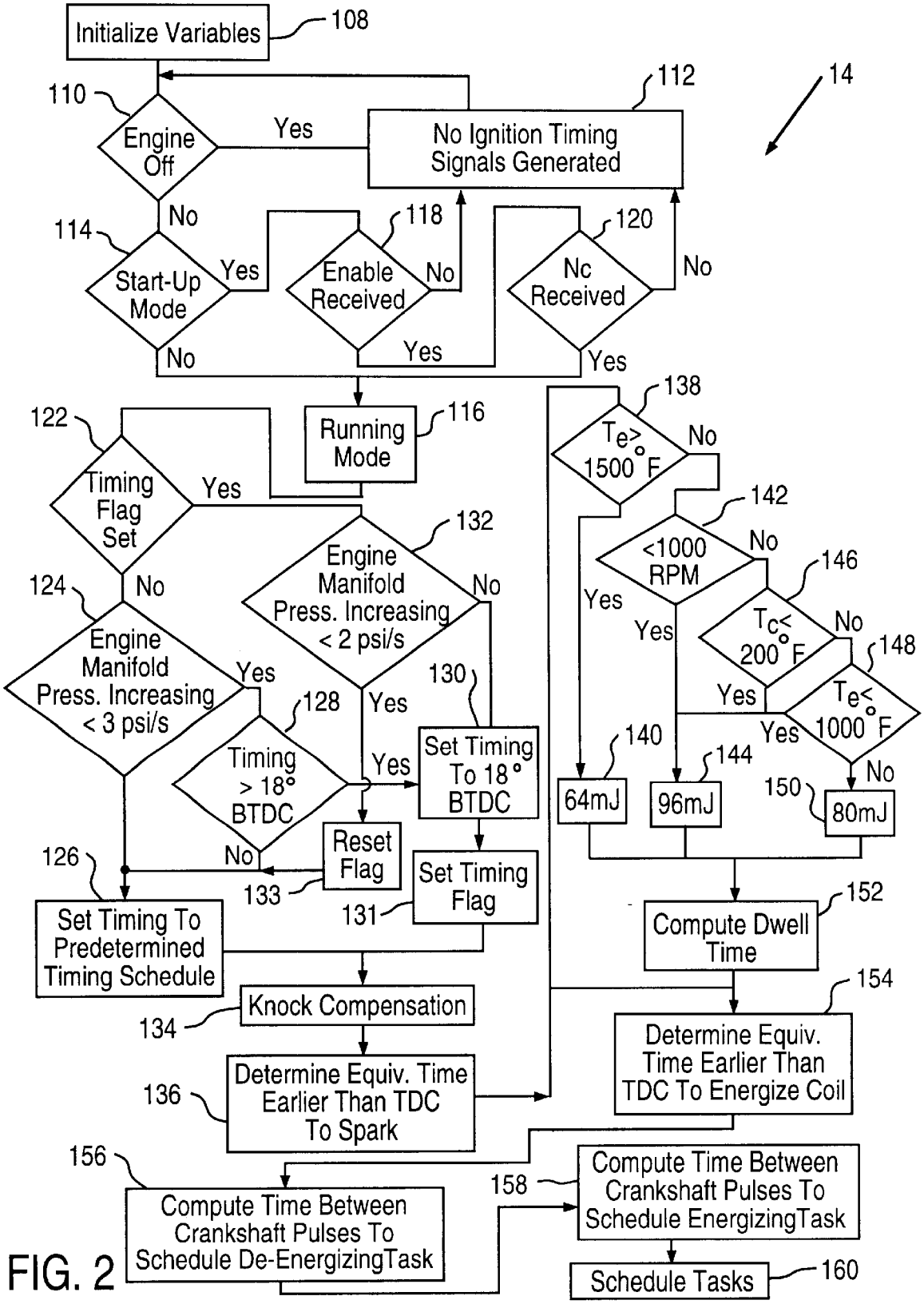
FIG. 2 is a diagram illustrating a process flow through the spark control module of the system illustrated in FIG. 1.

FIG. 2 is a diagram illustrating a process flow through the spark control module 14 illustrated in FIG. 1. The ignition module 14 determines the proper spark energy and the proper spark timing, and schedules the events for execution by the system 10 to optimize energy operating conditions. FIG. 2 illustrates one embodiment of the process flow, and may be modified for a particular engine and desired operating conditions.

The process flow begins at block 108, where all internal flag values are reset. The flow proceeds to block 110.

Block 110 determines if the engine 20 is off. If the engine 20 is off, the process proceeds to block 112, where no ignition timing signals are generated, and thereafter back to block 110. The process cycles between blocks 108 and 110 until the engine 20 is turned on. If the engine 20 is on, the process proceeds to block 114 which determines whether the engine 20 is in start-up mode.

At block 114, if the engine 20 is not is start-up mode, the process proceeds to block 116. If the engine 20 is in start-up mode, the engine 20 is starting and the process waits for an "Enable" signal, which is indicative of a command to turn the controller 12 on, and the first camshaft pulse (Nc) before generating ignition timing commands. Block 118 determines if the "Enable" signal is asserted and block 120 determines if signal Nc, indicative of a camshaft pulse, has been received. If either of those conditions are not satisfied, the process proceeds to block 112. If both are satisfied, the process proceeds to block 116, which indicates that the engine is in the running mode and, therefore, ignition signals should be generated.

Block 122 determines if a timing flag has been set during a prior ignition timing event for reasons described hereinbelow. If no timing flag has been set, the process flow continues to block 124.

Block 124 determines whether the engine manifold pressure is increasing at a rate greater than a predetermined rate. If the engine manifold pressure is not increasing greater than the predetermined rate, the process continues to block 126, and if the pressure is increasing at rate greater than the predetermined value, the process proceeds to block 128. In the illustrated embodiment, the predetermined rate is 3 psi/s. A high rate of increase in manifold pressure is indicative of rapid engine acceleration, for which special ignition timing commands may be beneficial. For example, under rapid acceleration peak pressure in the combustion chamber may occur prematurely unless ignition timing is retarded. The special timing commands are discussed hereinbelow with respect to block 128.

Block 126 sets the spark timing to a predetermined basic advance schedule particular to the engine and desired operating conditions. The predetermined basic advance timing schedule indicates spark timing for a given engine speed and mode. For example, for an aircraft engine, the predetermined basic advance timing schedule may indicate the point during the engine cycle to ignite a spark based on whether the aircraft is, for example, starting, idling, cruising, and taking off.

One example of the basic advance timing schedule for an aircraft engine is provided in FIG. 3. For the embodiment illustrated in FIG. 3, the timing schedule is broken down into various engine modes, including starting, idle, low power, low power (LP) cruise, high power (HP) cruise, maximum continuous power (MCP), takeoff, and overspeed. Provided for each applicable engine speed and mode combination is a base spark timing in degrees BTDC. Where a range of base spark timings is provided for a particular range of engine speeds, the spark timing is related linearly to the engine speed range. Thus, for example, where the timing schedule shows an engine speed of 300 to 900 rpm, the spark timing increases linearly with the engine speed from 0 to 18 degrees BTDC. The timing schedule may be stored in the memory of the controller 12. FIG. 3 illustrates one example of a basic advance timing schedule, which may be modified for a particular engine or desired operating conditions.

Returning to FIG. 2, block 128 determines whether the timing advance is greater than a predetermined value. In the illustrated embodiment, the value is 18° BTDC. If the timing advance is greater than the predetermined value, then spark timing is retarded to another predetermined value until the rate of increase of the engine manifold decreases. For the illustrated embodiment, the predetermined timing is set at 18° BTDC at block 130, and the timing flag is set at block 131. If the timing is not greater than the predetermined value, then the process proceeds to block 126.

The significance of the timing flag will be discussed by returning to block 122. If the timing flag is set, indicating that the timing flag has been set at block 130, the process proceeds from block 122 to block 132. Block 132 determines if the engine manifold pressure is increasing less than a predetermined value. For the illustrated embodiment, the predetermined value is 2 psi/s. If engine manifold pressure is not increasing less than the predetermined value, the flow proceeds to block 130, where the ignition timing is retarded to the predetermined value, such as 18° BTDC as in the illustrated embodiment. Maintaining the ignition timing at the retarded value until the rate of increase of the engine manifold pressure decreases to the predetermined value provides hysteresis to prevent cycling between timing controls in block 126 and timing controls in block 130. Otherwise, such cycling may occur when the manifold pressure increase rate is approximately the predetermined value (e.g. 3 psi/s), resulting in less efficient operation of the engine. If the engine manifold pressure is increasing less than the predetermined value, the process proceeds to block 133 where the flag is reset, and then to block 126.

With the ignition timing determined according to either block 126 or 130, the process flow advances to block 134 where the controller 12 modifies the ignition timing to compensate for engine knock. Engine knock is the detonation of the fuel-air mixture in the engine cylinder, and may cause engine damage and excessive cylinder head temperatures, both of which may severely reduce the life of the engine. To compensate for engine knock, the ignition time may be retarded according to the severity of the knock. For example, the signal K may supply a signal indicative of the severity of engine knock to the controller 12. Based on the severity of the knock, the knock accommodation module 22 generates signals which may be utilized by the spark control module 14 to retard the ignition timing. Alternatively, the knock accommodation module 22 may generate knock signal to retard timing only when the engine manifold pressure is greater than 10 psia. The knock accommodation module 22 may generate signals according to a predetermined compensation table. For example, the following table may be utilized in determining the level of retardation of the spark to compensate for knock:

| KNOCK SIGNAL LEVEL | COMPENSATION |
|---|---|
| No Knock | −0.0° |
| Incipient Knock | −0.5° |
| Light Knock | −2.0° |
| Heavy Knock | −8.0° |
| Severe Knock | −16.0° |

The above table illustrates but one example of a compensation schedule, and may be modified according to the particular engine and the desired engine operating conditions. In addition, the knock compensation may be applied cumulatively to the base advance timing schedule up to a maximum retardation of, for example, 0° BTDC. That is, if the amount of knock changes from one ignition event to the next, then the appropriate timing compensation may be applied and accumulated even if it differed from the compensation of the last ignition event. To allow the spark timing to "creep" back to the schedule over a period of ignition events, regardless of the compensation due to knock, the spark timing may be advanced by a small increment such as, for example 0.01°, up to limit for the base advance schedule for the current operating conditions, thereby allowing the cylinder time to cool and avoid knocking.

The flow then continues to block 136, where the controller 12 computes the spark advance timing with the reference point of Top Dead Center (TDC) of the engine cycle to ignite the spark. The equivalent time is based on the length of time of the engine cycle and the determined optimal spark timing as a function of crankshaft angle. The length of time of the engine cycle may be determined by the controller 12 according to signal Ne, which is indicative of the crankshaft speed.

Having determined the desired spark timing, the process determines the desired spark energy intensity based on the energy operating conditions. To determine the desired spark energy, the flow proceeds to block 138. Block 138 determines the exhaust temperature of the engine. If the exhaust temperature is greater than a predetermined value, the engine may be considered to be running "hot," and it may be desirous to provide a relatively low spark energy intensity. For example, for the illustrated embodiment, if the exhaust temperature is greater than 1500° F., the spark energy is set at 64 millijoules (mJ) at block 140. In other embodiments of the present invention, the critical exhaust temperature at which to establish a lower spark energy may vary according to the particular engine and the desired operating conditions. If the engine exhaust temperature does not exceed the predetermined value, the flow advances to block 142.

Block 142 determines if the engine is operating below a predetermined value of revolutions per minute (rpm). For the illustrated embodiment, the predetermined value is 1000 rpm. If the engine is operating below the predetermined speed, it may be beneficial to provide a relatively high spark energy. If the engine is operating at less than predetermined speed, the flow proceeds to block 144 where the controller sets the spark energy at 96 mJ. In other embodiments of the present invention, the predetermined operating speed and spark energy may vary according to the particular engine and the desired operating conditions. If the engine 20 is not operating at a speed less than the predetermined speed, the flow continues to block 146.

Block 146 determines whether the cylinder head temperature is less than a predetermined value. For the illustrated embodiment, the predetermined temperature is 200° F. If the cylinder head temperature is below the predetermined value, it may be desirous to provide a relatively high spark energy, in which case flow continues to block 144 where the spark energy is set at 96 mJ. In other embodiments of the present invention, the critical cylinder head temperature at which to provide a relatively high spark energy may vary according to the particular engine and the desired operating conditions. In addition, in other embodiments of the present invention, the spark energy provided when the cylinder head temperature is less than the predetermined value is not the same as the spark energy provided when the engine operating speed is less than the predetermined rpm. If the cylinder head temperature is not less than the predetermined value, the flow proceeds to block 148.

Block 148 determines if the exhaust temperature is less than a predetermined value. For the illustrated embodiment, the value is 1000° F. If the exhaust temperature is less than the predetermined value, it may be beneficial to provide a relatively high spark energy intensity, in which case the flow proceeds to block 144 where the spark energy is set at 96 mJ. In other embodiments of the present invention, the critical exhaust temperature at which to provide a relatively high spark energy may vary according to the particular engine and the desired operating conditions. In addition, in other embodiments of the present invention, the provided spark energy may be different than the spark energy provided under other engine operating circumstances in which a relatively high spark energy is desired. If the exhaust temperature is greater than the predetermined value, the flow advances to block 150.

Block 150 sets the spark energy to a predetermined value which may be considered a "normal" level. For the illustrated embodiment, the predetermined value is 80 mJ. For other embodiments of the present invention, the normal spark energy may be set at alternative levels according to the particular engine and the desired operating conditions.

Having determined the desired spark energy at either blocks 140, 144, or 150 depending on the engine operating conditions, the flow proceeds to block 152. Block 152 computes the dwell time to realize the desired spark energy intensity at block 152. As discussed hereinbefore, the dwell time is the length of time necessary for the magnetic flux field induced by electrical current in the primary winding 60 to reach the desired limit, and corresponds to the length of time that switch 58 is closed and the voltage supplied by the power supply 54. The dwell time necessary to achieve a desired spark energy, as discussed hereinbefore, may expressed according to the relationship:

$$T_{dwell}=(2EL)^{1/2}/V \quad (4)$$

where E is the desired spark energy, L is the inductance of the primary winding 60, and V is the voltage supplied from the power supply 54. As discussed hereinbefore, particularly for aircraft engines, the voltage supplied from the power supply 54 may vary significantly, which consequently affects the necessary dwell time to achieve an optimal spark energy. The flow then proceeds to block 154.

Block 154 determines the equivalent time earlier than TDC to energize the coil 15, which corresponds to the time earlier than TDC to close the switch 58. The point in time may be determined by adding the necessary dwell time necessary to achieve the desired spark energy, as determined at block 152, to the time earlier than TDC at which the switch 58 is to open to achieve the proper spark timing, as determined at block 136.

Having determined the time to open and close the switch 58 to realize the desired spark timing and energy, the process schedules the respective tasks. Block 156 computes the time between crankshaft pulses (Nc) to schedule the de-energizing control task. Block 158 computes the time between crankshaft pulses (Nc) to schedule the energizing task control. The flow then proceeds to block 160, which schedules the de-energizing and energizing tasks to achieve optimal spark timing and spark energy.

Figure 4:
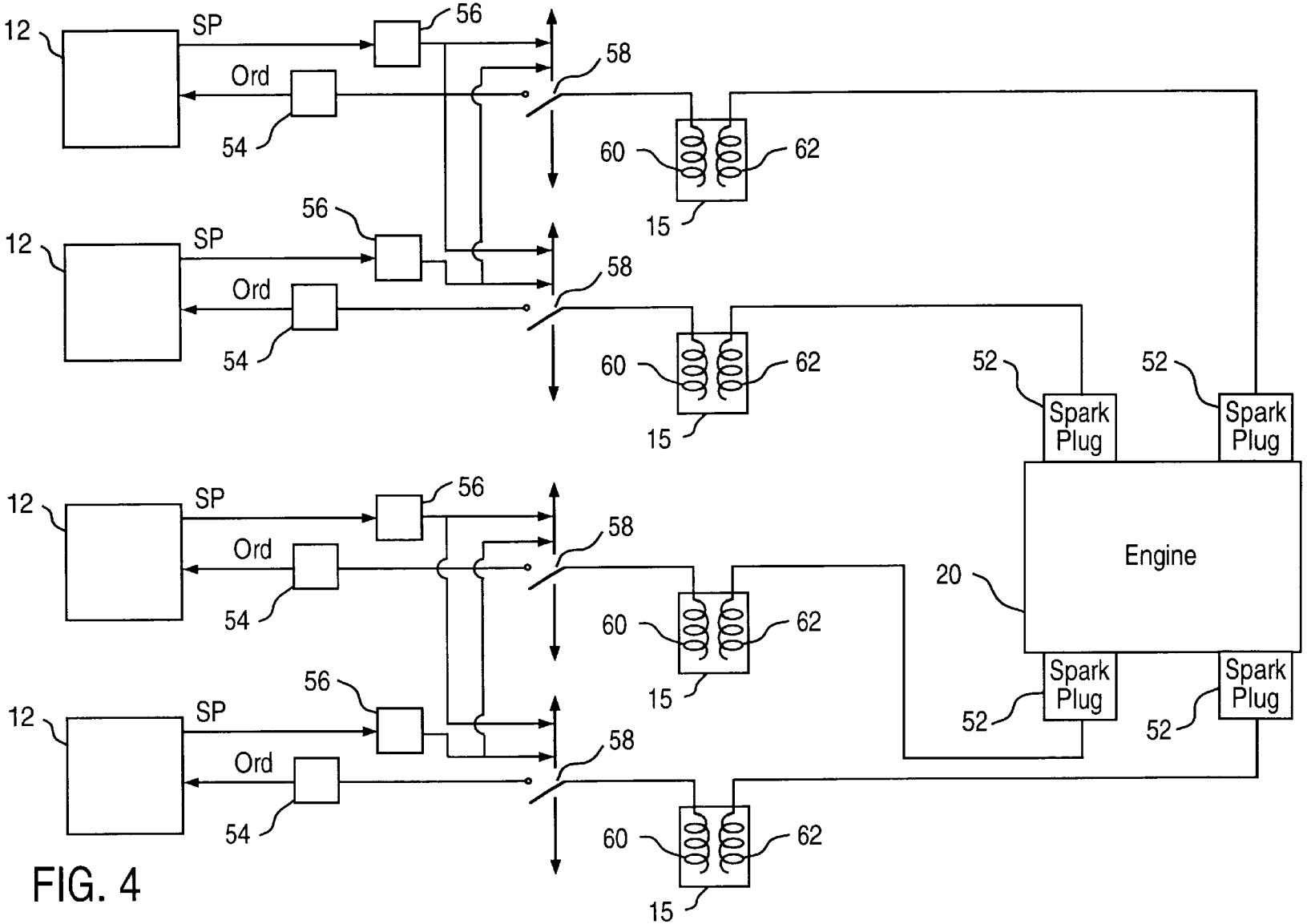
FIG. 4 is a diagram illustrating the control system according to another embodiment of the present invention.

FIG. 4 illustrates an alternative embodiment of the present invention wherein the system 10 includes a controller 12 for each spark plug 52, and where each controller 12 controls the timing and energy of two spark plugs 52. For simplicity, the input interface and output interface have been omitted from FIG. 3. The controllers 12 may be the same as illustrated in FIG. 1, and include a spark control module 14 as illustrated in FIG. 2. The redundant control illustrated in FIG. 4 may be beneficial for certain applications, such as for aircraft engines to allow continued operation of the aircraft if one of the controllers 12 should happen to lose power during flight. The system illustrated in FIG. 4 includes an engine 20 having a number of spark plugs 52, each connected to one ignition coil 15, having a primary winding 60 and a secondary winding 62. Alternatively, each ignition coil 15 may control two spark plugs 58, both of which may be in one cylinder. Each ignition coil 52 is connected to a switch 58, which may be, for example, a FET or a BJT. Each switch 58 is connected to a power supply 54, and in communication with two controllers 12. The switches 58 are connected to the controllers 12 via on-time logic circuits 56, and the controller 12 transmits signal SP to the switches 58 in order to control their operation as described hereinbefore. In other embodiments of the present invention, alternative redundant control configurations may be employed.

The present invention is also directed to a method of controlling spark energy of a spark plug of a combustion engine. The method includes connecting the spark plug 52 to the secondary winding 62 of the ignition coil 15. The secondary winding 62 is inductively coupled to the primary winding 60. The method also includes determining a spark energy intensity based on at least one engine operating condition, and determining a period of time to supply current to the primary winding 60 to achieve the determined spark energy intensity from the spark plug 52 as a function of a voltage supplied from a power supply 54 to the primary winding 60. The method further includes connecting the power supply 54 to the primary winding 60 for the determined period of time. The method may further include determining the proper time during the engine cycle to ignite a spark from the spark plug 52, and disconnecting the power supply 54 from the primary winding 60 at the determined time.

Those of ordinary skill in the art will recognize that many modifications and variations of the present invention may be implemented. For example, the flow through module 14 may be alternatively arranged to still realize the benefit of the present invention. The foregoing description and the following claims are intended to cover all such modifications and variations. Furthermore, the materials and processes disclosed are illustrative, but are not exhaustive. Other materials and processes may also be used to make devices embodying the present invention. Moreover, the present invention may be realized by performing the steps in processes described herein in various sequences.

What is claimed is:

1. A computer-assisted method for controlling spark energy from a spark plug of a combustion engine, comprising:

determining a spark energy intensity based on an exhaust temperature of the engine;

determining a period of time to supply current to an ignition coil connected to the spark plug to achieve the determined spark energy intensity from the spark plug as a function of a voltage supplied from a power supply to the ignition coil; and connecting the power supply to the ignition coil for the determined period of time.

2. The method of claim 1, wherein determining the spark energy intensity includes determining the spark energy intensity based on a second engine operating condition selected from the group consisting of cylinder head temperature and engine speed.

3. The method of claim 1, further comprising:

determining a time during a cycle of the engine to ignite a spark from the spark plug based on at least one sensed engine operating condition; and disconnecting the power supply from the ignition coil at the determined time during the engine cycle.

4. The method of claim 3, wherein determining the time during the cycle includes determining the time during the cycle based on at least one sensed engine operating condition selected from the group consisting of engine manifold pressure and engine knock.

5. A computer-assisted method for controlling spark energy from a spark plug of a combustion engine, comprising:

connecting the spark plug to a secondary winding;

inductively coupling the secondary winding to a primary winding;

determining a spark energy intensity based on an exhaust temperature of the engine;

determining a period of time to supply current to the primary winding to achieve the determined spark energy intensity from the spark plug as a function of a voltage supplied from a power supply to the primary winding; and connecting the power supply to the primary winding for the determined period of time.

6. The method of claim 5, further comprising:

determining a point during a cycle of the engine to ignite a spark from the spark plug based on at least one sensed operating condition of the engine; and disconnecting the power supply from the primary winding at the determined point during the engine cycle.

7. The method of claim 5, wherein determining the spark energy intensity includes determining the spark energy intensity based on a second sensed engine operating condition selected from the group consisting of cylinder head temperature and engine speed.

8. The method of claim 6, wherein determining the point during the cycle to ignite the spark includes determining a point during the cycle of the engine to ignite the spark based on at least one sensed engine operating condition selected from the group consisting of engine manifold pressure and engine knock.

9. A system for controlling spark energy of a combustion engine, comprising:

a spark plug;

a secondary winding connected to the spark plug;

a primary winding inductively coupled to the secondary winding;

a switch connected to the primary winding;

a power supply connected to the switch; and a spark control module in communication with the switch, the spark control module for controlling the switch based on sensed engine operating conditions and a voltage supplied from the power supply, wherein the spark control module includes:

a first circuit for determining a spark energy intensity based on an exhaust temperature of the engine;

a second circuit in communication with the first circuit for determining a period of time to supply current to the primary winding to achieve the determined spark energy intensity from the spark plug as a function of the voltage supplied from the power supply; and a third circuit in communication with the second circuit for transmitting a signal to the switch to connect the power supply to the primary winding for the determined period of time.

10. (Amended) The system of claim 9, wherein the spark control module further includes:

a fourth circuit for determining a time during a cycle of the engine to ignite a spark from the spark plug based on at least one sensed engine operating condition; and a fifth circuit in communication with the fourth circuit for transmitting a signal to the switch to disconnect the power supply from the primary winding at the determined time during the engine cycle.

11. The system of claim 9, wherein the first circuit is for determining the spark energy intensity based on a second sensed engine operating condition selected from the group consisting of cylinder head temperature and engine speed.

12. The system of claim 9, wherein the spark control module is in communication with the switch via a logic circuit.

13. A computer-implemented method for controlling spark energy from a spark plug of a combustion engine, comprising:

determining a desired spark energy intensity based on an exhaust temperature of the engine;

determining a period of time to energize an ignition coil connected to the spark plug to achieve the desired spark energy intensity as a function of a voltage supplied to the ignition coil; and transmitting a signal to energize the ignition coil for the determined period of time.

14. The method of claim 13, further comprising:

determining a point during a cycle of the engine to ignite a spark from the spark plug based on at least one sensed engine operating condition; and transmitting a signal to de-energize the ignition coil at the determined point during the engine cycle.

15. The method of claim 13, wherein determining a desired spark energy intensity includes determining the desired spark energy intensity based on a second sensed engine operating condition.

16. A computer-readable medium having stored thereon instructions which when executed by a processor cause the processor to:

determine a desired spark energy intensity for a spark plug of a combustion engine based on an exhaust temperature of the engine;

determine a period of time to energize an ignition coil connected to the spark plug to achieve the desired spark energy intensity based on a voltage supplied to the ignition coil.

17. The computer-readable medium of claim 16 further comprising instructions which when executed by the processor cause the processor to determine a time during a cycle of the engine to ignite a spark from the spark plug based on at least one sensed engine operating condition.

18. The computer readable medium of claim 16, further comprising instructions which when executed by the processor cause the processor to determine the desired spark energy intensity based on a second sensed engine operating condition.

19. An ignition spark energy module, comprising:

a first circuit for determining a desired spark energy intensity for a spark plug of a combustion engine based on an exhaust temperature of the engine; and a circuit in communication with the first circuit for determining a period of time to energize an ignition coil connected to the spark to achieve the determined spark energy based a magnitude of a voltage supplied to the ignition coil.

20. The module of claim 19, further comprising a third circuit in communication with the first circuit for determining a time during a cycle of the engine to de-energize the ignition coil based on at least one sensed engine operating condition.

21. The module of claim 20, further comprising a fourth circuit in communication with the second circuit for scheduling energizing and de-energizing tasks during the engine cycle.

22. The ignition spark energy module of claim 19, wherein the first circuit is further for determining a desired spark energy intensity based on a second sensed engine operating condition.

23. An ignition spark control module, comprising:

means for determining a desired spark energy intensity for a spark plug of a combustion engine based on an exhaust temperature of the engine; and means for determining a period of time to energize an ignition coil connected to the spark to achieve the determined spark energy based a magnitude of a voltage supplied to the ignition coil.

24. The module of claim 23, further comprising means for determining a time during a cycle of the engine to de-energize the ignition coil based on at least one sensed engine operating condition.

25. The module of claim 24, further comprising means for scheduling energizing and de-energizing tasks during the engine cycle.

26. The ignition spark energy module of claim 23, wherein the means for determining a desired spark is further for determining a desired spark based on a second sensed engine operating condition.

27. A system for controlling spark energy of a combustion engine, comprising:

a spark plug;

a secondary winding connected to the spark plug;

a primary winding inductively coupled to the secondary winding;

a power supply;

means for determining a desired spark energy intensity based on an exhaust temperature of the engine; and means for connecting the power supply to the primary winding for a period of time to achieve the desired spark energy intensity based on a voltage supplied from the power supply to the primary winding.

28. The system of claim 27, further comprising:

means for determining a time during a cycle of the engine to ignite a spark from the spark plug based on at least one sensed engine operating condition; and means for disconnecting the power supply from the primary winding at the determined time during the cycle.

29. The system of claim 27, wherein the means for determining a desired spark is further for determining a desired spark based on a second sensed engine operating condition.

30. A system for controlling spark energy of a combustion engine, comprising:

a plurality of spark plugs;

a plurality of secondary windings, each of the plurality of secondary windings connected to one of the plurality of spark plugs;

a plurality of primary windings, each of the plurality of primary windings inductively coupled to one of the secondary windings;

a plurality of switches, each of the plurality of switches connected to one of the plurality of primary windings;

a plurality of power supplies, each of said plurality of power supplies connected to one of the plurality of switches;

a plurality of spark control modules in communication with the plurality of switches, each of the spark control modules for controlling one of the plurality of switches to achieve a desired spark energy intensity based on an exhaust temperature of the engine.

31. The system of claim 30, wherein each of the spark control modules includes:

a first circuit for determining a desired spark energy intensity for one of the plurality of spark plugs based on the exhaust temperature;

a second circuit in communication with the first circuit for determining a period of time to supply current to one of the plurality of primary windings from the power supply to achieve the desired spark energy intensity as a function of a voltage supplied from the power supply; and a third circuit in communication with the second circuit for transmitting a signal to one of the plurality of switches to connect one of the plurality of power supplies to the primary winding for the determined period of time.

32. The system of claim 30, wherein each of the plurality of spark control modules is in communication with two of the plurality of switches.

33. The system of claim 31, wherein the spark control module further includes:

a fourth circuit for determining a time during the engine cycle to ignite a spark from one of the plurality of spark plugs based on at least one sensed engine operating condition; and a fifth circuit in communication with the fourth circuit for transmitting a signal to one of the plurality of switches to disconnect the power supply from the primary winding at the determined time during the engine cycle.

34. The system of claim 31, wherein the first circuit is further for determining the desired spark for one of the plurality of spark plugs based on a second sensed engine operating condition.

* * * * *